US007048559B2

(12) United States Patent
Shobara et al.

(10) Patent No.: US 7,048,559 B2
(45) Date of Patent: May 23, 2006

(54) CARD CONNECTOR

(75) Inventors: Yoshitaka Shobara, Kanagawa (JP); Yozo Tomonari, Kanagawa (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 10/520,896

(22) PCT Filed: Jul. 23, 2003

(86) PCT No.: PCT/JP03/09307

§ 371 (c)(1),
(2), (4) Date: Jan. 11, 2005

(87) PCT Pub. No.: WO2004/010541

PCT Pub. Date: Jan. 29, 2004

(65) Prior Publication Data

US 2005/0221681 A1 Oct. 6, 2005

(30) Foreign Application Priority Data

Jul. 24, 2002 (JP) ..... 2002-215665

(51) Int. Cl.
*H01R 13/62* (2006.01)

(52) U.S. Cl. ..... 439/159

(58) Field of Classification Search ..... 439/159, 439/630, 680

See application file for complete search history.

(56) References Cited

U.S. PATENT DOCUMENTS 6,109,941 A * 8/2000 Koseki et al. ..... 439/159
6,162,075 A * 12/2000 Hara et al. ..... 439/159
6,319,028 B1 * 11/2001 Zhang et al. ..... 439/159
6,319,029 B1 * 11/2001 Nishioka ..... 439/159
6,332,790 B1 * 12/2001 Ishikawa et al. ..... 439/157
6,652,299 B1 * 11/2003 Sato ..... 439/159
6,776,632 B1 * 8/2004 Kikuchi et al. ..... 439/159
2001/0049232 A1 * 12/2001 Takei et al. ..... 439/630
2002/0115350 A1 * 8/2002 Nishio et al. ..... 439/630

FOREIGN PATENT DOCUMENTS

| | | | |
|---|---|---|---|
| EP | 895178 | A2 | 2/1999 |
| JP | 62-125966 | U | 8/1987 |
| JP | 2000-12158 | A | 1/2000 |
| JP | 2000-200647 | A | 7/2000 |

OTHER PUBLICATIONS

International Search Report mailed on Aug. 3, 2003.
English Translation of International Preliminary Report for PCT/JP2003/009307.

* cited by examiner

*Primary Examiner*—Tulsidas C. Patel
*Assistant Examiner*—Vladimir Imas
(74) *Attorney, Agent, or Firm*—Rader, Fishman & Grauer PLLC

(57) ABSTRACT

A card connector (1) comprises a first insulative frame (4) fixed to a mounting surface (3*a*), and a second metal frame (5) defining an insertion cavity (10) for a card (2) between the mounting surface (3*a*) and the second frame (5). The second frame (5) is of a channel shape, and has first and second side walls (5*b*, 5*c*). An inverted card insertion preventing projection (30) for preventing the card (2) from being inserted upside down into the insertion cavity (10) is provided on one of the first and second side walls (5*b*, 5*c*). The inverted card insertion preventing projection (30) projects in an area (A) of the insertion cavity (10) associated with the first half of a card inserting stroke.

14 Claims, 8 Drawing Sheets

CARD CONNECTOR

BACKGROUND OF THE INVENTION

1. Field of the Invention

The present invention relates to a connector for a card such as an IC card.

2. Description of Related Art

In FIG. 11A, there is shown a connector 80 as a card connector of this type. In the connector 80, an insertion cavity 85 for receiving a card 84 inserted therein is defined, as shown in FIG. 11A, by fixing a synthetic resin frame 82 of a generally open-square shape as seen in plan onto a substrate 81 and covering the frame 82 with a channel-shaped metal frame 83 as shown in FIG. 11B.

In general, an inverted insertion preventing structure for preventing the card 84 from being inserted upside down into the insertion cavity 85 is provided on a side wall 86 of the synthetic resin frame 82.

Lateral sides of the insertion cavity 85 of the connector of FIG. 11A are respectively defined by lateral side walls 86 of the synthetic resin frame 82. This poses a problem that the card connector 80 has a laterally expanded footprint on the substrate 81.

A conceivable approach to reduction of the footprint is to significantly reduce the lengths of the side walls 86 of the synthetic resin frame 82, reduce the thicknesses of the side walls 86 and define the lateral sides of the insertion cavity 85 by lateral side walls 87 of a cover 83.

In this case, however, the lateral side walls 86 of the synthetic resin frame 82 are disposed in an inner portion of the insertion cavity 85, so that the inverted card insertion preventing structure is disposed in the inner portion of the insertion cavity 85. As a result, a user does not realize the inverted insertion until the card 84 is inserted deeply into the inner portion of the insertion cavity 85.

Hence, there is a possibility that the user forcibly squeezes the card 84 into the innermost position of the insertion cavity 85 to damage the card 84 and the like.

SUMMARY OF THE INVENTION

It is an object of the present invention to provide a card connector which assuredly prevents the inverted insertion of a card with a simplified structure.

According to a preferred mode of the present invention to achieve the aforesaid object, there is provided a card connector, which comprises: an insertion cavity for receiving a card inserted therein in a card inserting direction; a first insulative frame fixed to a mounting surface and defining a rear side of the insertion cavity; a plurality of contacts held by the first frame as facing toward the insertion cavity; a second metal frame of a channel shape fixed to the mounting surface and having a top plate parallel to the mounting surface and first and second side walls to define the insertion cavity between the mounting surface and the second frame; and an inverted card insertion preventing projection provided on one of the first and second side walls of the second frame for preventing the card from being inserted upside down into the insertion cavity, the inverted card insertion preventing projection projecting in an area of the insertion cavity associated with the first half of a card inserting stroke.

According to this mode, the insertion cavity is defined by the first and second side walls of the second frame of the channel-shaped metal plate, so that the footprint of the card connector on the mounting surface can be reduced. In addition, a user is alerted to the inverted cart insertion at a relatively early stage of the card insertion. Thus, the inverted card insertion can assuredly be prevented.

DESCRIPTION OF THE PREFFERED EMBODIMENTS

Preferred embodiments of the present invention will be described with reference to the attached drawings.

Figure 1:
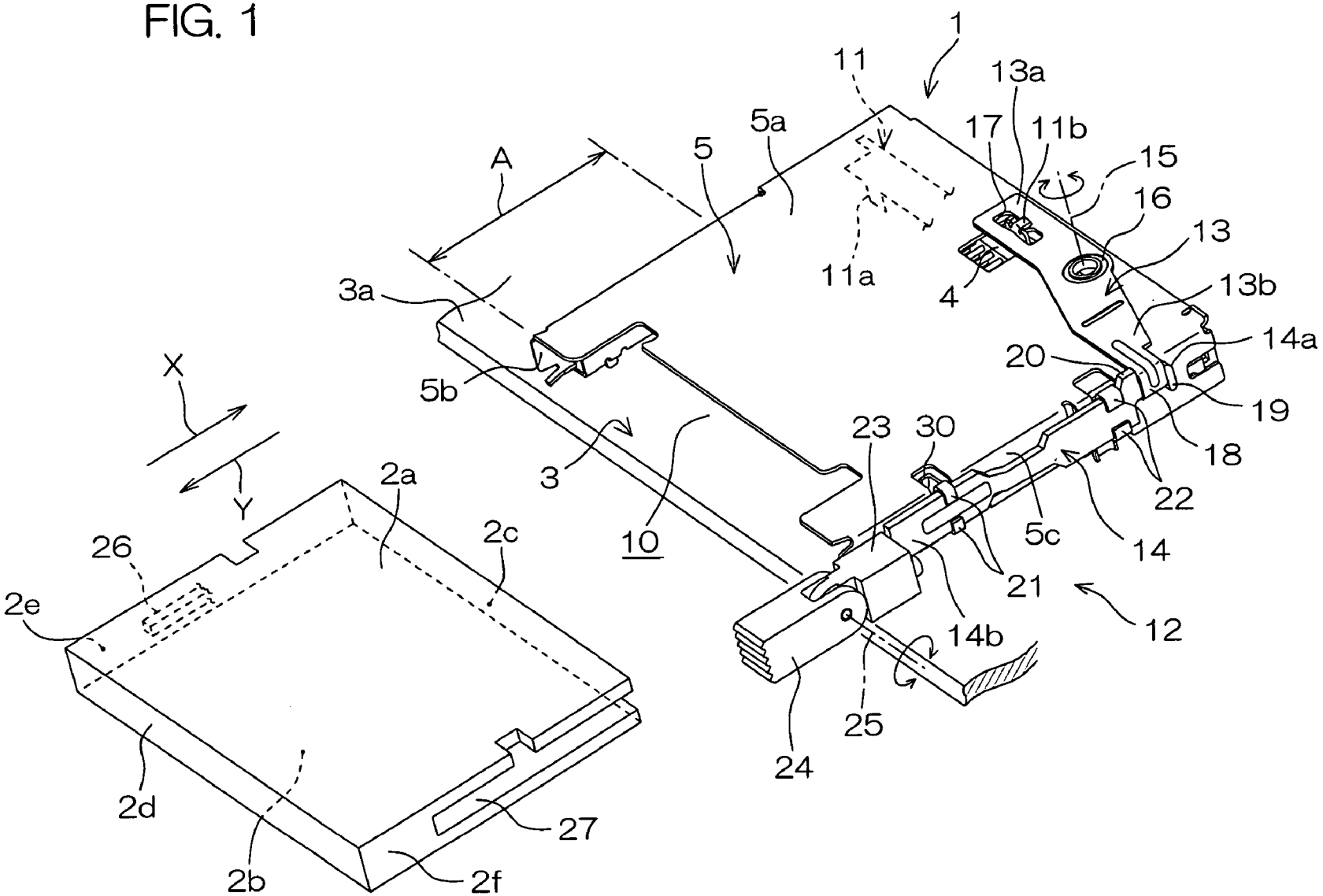
FIG. 1 is an exploded perspective view of a card connector according to one embodiment of the present invention and a card.
Figure 2:
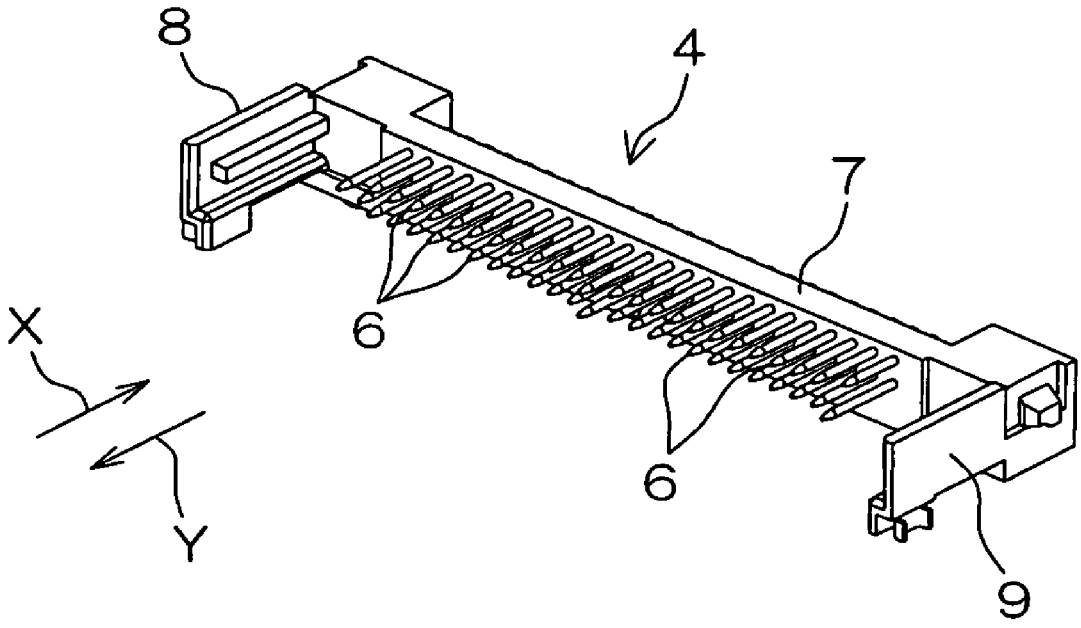
FIG. 2 is a perspective view of a first synthetic resin frame which holds pin contacts.

FIG. 1 is an exploded perspective view of a card connector according to one embodiment of the present invention and a card. Referring to FIG. 1, a card connector 1 is a connector in which a card 2 such as an IC card is inserted in an inserting direction X and set, and is constructed such that a first frame 4 of a synthetic resin having an open square shape as shown in FIG. 2 and a second frame 5 of a channel-shaped metal plate as shown in FIG. 1 are provided on a surface of a substrate 3 as a mounting surface 3*a*. The second frame 5 has a top plate 5*a* and first and second side walls 5*b* and 5*c*.

The card 2 has a front face 2*a*, a back face 2*b*, an insertion side end face 2*c*, an ejection side end face 2*d*, a first lateral side face 2*e* and a second lateral side face 2*f*. Though not shown, the insertion side end face 2*c*, which serves as a connection face of the card 2, is provided with a multiplicity of socket contacts.

Referring to FIG. 2, on the other hand, the first frame 4 is insulative, and serves as a pin housing in which a multiplicity of pin contacts 6 to be connected to the socket contacts of the card 2 are press-fitted. More specifically, the first frame 4 includes a main portion 7 which holds the pin contacts 6, and a pair of lateral side walls 8 and 9 each having a smaller length and extending from opposite ends of the main portion 7 in a card ejecting direction Y.

Referring to FIG. 1, the connector 1 has an insertion cavity 10 defined between the second frame 5 and the substrate 3 for receiving the card 2 inserted therein in the inserting direction X. The first frame 4 is disposed behind the insertion cavity 10. An eject arm 11 of a metal plate for ejecting the card 2 from the insertion cavity 10 in the ejecting direction Y by pressing the insertion side end face 2*c* of the card 2 inserted in the insertion cavity 10 is also disposed behind the insertion cavity 10.

Figure 3A:
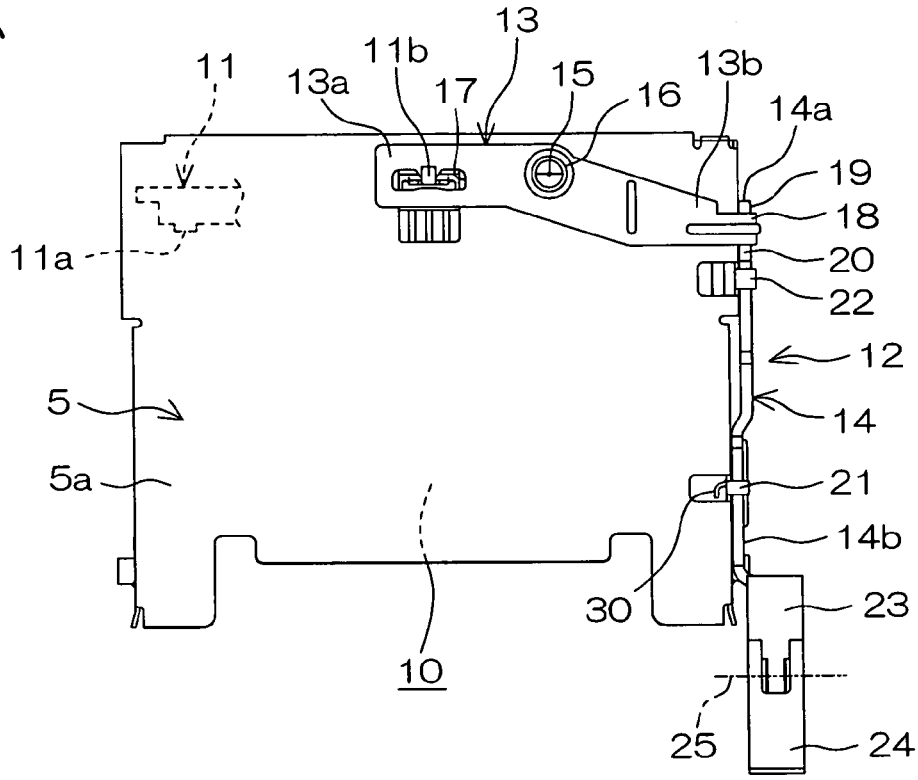
FIGS. 3A and 3B are a plan view and a front view, respectively, of the card connector.
Figure 3B:
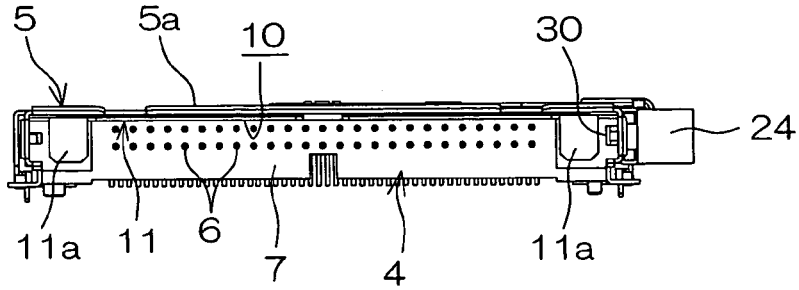

Referring to FIG. 1 and FIGS. 3A and 3B which are a schematic plan view and a schematic front view, respectively, of the card connector 1, the eject arm 11 is slidable on a lower surface of the top plate 5*a* of the second frame 5. A pair of first engagement portions 11*a* (particularly shown in FIG. 3B but only one of the first engagement portions shown in FIGS. 1 and 3A) to be engaged with the insertion side end face 2*c* of the card 2 are provided at laterally opposite ends of the eject arm 11, and a second engagement portion 11*b* to be engaged with a metal plate link arm 13 of an eject mechanism 12 is provided at a middle portion of the eject arm 11.

The eject mechanism 12 includes an operation arm 14 of a metal plate manually operated and supported slidably in the card inserting direction X and in the card ejecting direction Y on an outer surface of the second side wall 5*c* of the second frame 5. The operation arm 14 is supported by a pair of angled guide support members 21 and 22 cut and raised from the second side wall 5*c*. The operation arm 14 is slidably guided along the outer surface of the second side wall 5*c* by the guide support members 21 and 22.

The eject mechanism 12 transfers the operation of the operation arm 14 to the eject arm 11 via the link arm 13, whereby the card 2 inserted and set in the insertion cavity 10 is ejected from the insertion cavity 10.

The link arm 13 is pivotal about an axis 15 on an upper surface of the top plate 5*a* of the second frame 5. This axis 15 is provided by a pivot 16 disposed at a middle position between first and second ends 13*a* and 13*b* of the link arm 13.

The second engagement portion 11*b* of the eject arm 11 is engaged with an engagement hole 17 provided at the first end 13*a* of the link arm 13. A bent engagement portion 18 provided at the second end 13*b* of the link arm 13 is engaged with a pair of engagement portions 19 and 20 provided at a first end 14*a* of the operation arm 14, whereby the second end 13*b* of the link arm 13 and the end of the operation arm 14 are pivotally coupled to each other.

A support portion 23 of a synthetic resin is fixed to a second end 14*b* of the operation arm 14, and an operation portion 24 to be depressed by a finger is supported by the support portion 23 pivotally about a predetermined axis 25 within an angular range of, for example, 90 degrees.

After the card 2 is inserted and set in the insertion cavity 10, the operation portion 24 is pivoted upward with respect to the support portion 23 into an out-of-use state for clearance. When the card 2 is to be ejected, the operation portion 24 is reclined from the out-of-use state into an in-use state in alignment with the support portion 23. Though not shown, the operation portion 24 can be kept in the in-use state and in the out-of-use state by a predetermined retention force.

Figure 4:
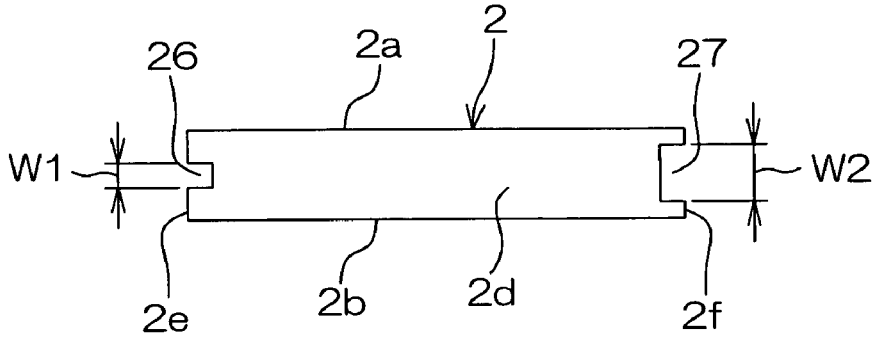
FIG. 4 is a diagram of the card as seen from an ejection side end face thereof.

Referring to FIG. 1 and FIG. 4 which illustrates the card 2 as seen from the ejection side end face 2*d*, first and second grooves 26 and 27 are respectively provided in the first and second lateral side faces 2*e* and 2*f* of the card 2 as extending in the ejecting direction Y to middle portions of the first and second lateral side faces 2*e* and 2*f*. As shown in FIG. 4, a width W2 of the second groove 27 is greater than a width W1 of the first groove 26.

Figure 5:
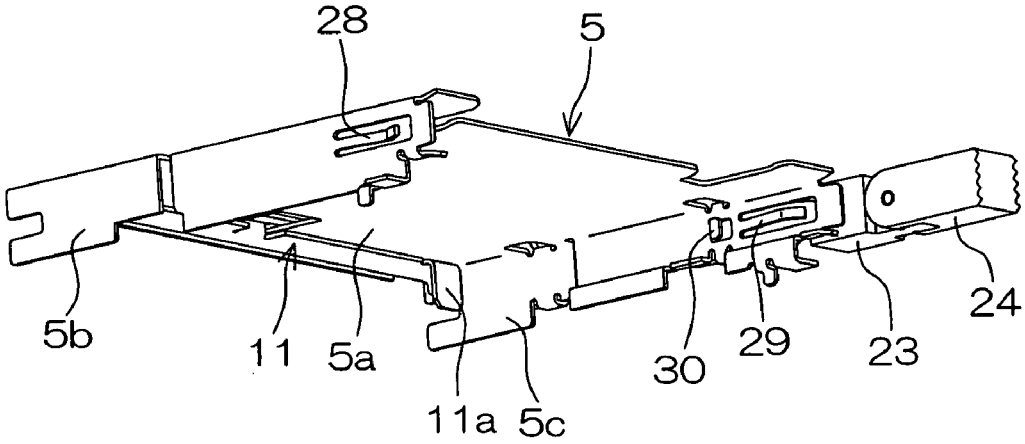
FIG. 5 is a perspective view of a second frame of a metal plate provided with an eject mechanism as seen from a diagonally lower side.

FIG. 5 is a perspective view of the second frame 5 provided with the eject arm 11 and the eject mechanism 12 as seen from a diagonally lower side. Referring to FIG. 5, the first and second side walls 5*b* and 5*c* of the second frame 5 are respectively provided with first and second grounding projections 28 and 29 projecting inward therefrom. The projections 28 and 29 are each raised from one side of a corresponding opening as having a chevron shape. The projections 28 and 29 are disposed in the vicinity of an entrance to the insertion cavity 10.

Though not shown, the front face 2*a*, the back face 2*b* and the lateral side faces 2*e* and 2*f* of the card 2 are partly covered with a metal shell, so that electrical connection from the metal shell of the card 2 inserted in the insertion cavity 10 to the substrate 3 via the first and second projections 28 and 29 and the second frame 5 is established for the grounding of the card 2. The first and second projections 28 and 29 may respectively be fitted in the first and second grooves 26 and 27 to guide the card 2 when the card 2 is inserted. That is, the first and second projections 28 and 29 may also serve as guide projections for the card insertion.

The second side wall 5*c* which supports the operation arm 14 of the eject mechanism 12 has an inverted card insertion preventing projection 30 provided inward of the second projection 29 (with respect to the inserting direction X) in the insertion cavity 10. The inverted card insertion preventing projection 30 is, for example, angled to project in the insertion cavity 10 as shown in FIG. 3A.

When the card 2 is inserted into the insertion cavity 10 by pressing the ejection side end face 2*d* thereof, the projections 28 and 29 move in the corresponding grooves 26 and 27 of the card 2 and, at the end of a card inserting stroke, are dislodged from the corresponding grooves 26 and 27 to ride on the corresponding lateral side faces 2*e* and 2*f* of the card 2. Thus, the projections 28 and 29 are brought into contact with the metal shell not shown on the lateral side faces 2*e* and 2*f* of the card 2 with a resilient depressing force.

However, the projections 28 and 29 are permitted to be fitted in the grooves 27 and 26, respectively, when the card 2 is inserted upside down into the insertion cavity 10 (with the front face 2*a* and the rear face 2*b* being inverted), i.e., when the inverted insertion occurs.

A feature of this embodiment is to assuredly prevent the inverted insertion described above at an early stage of the card insertion. Therefore, the inverted card insertion preventing projection 30 is disposed in a front half portion of the insertion cavity 10, i.e., in an area A associated with the first half of the card inserting stroke (see FIG. 1).

Figure 6A:
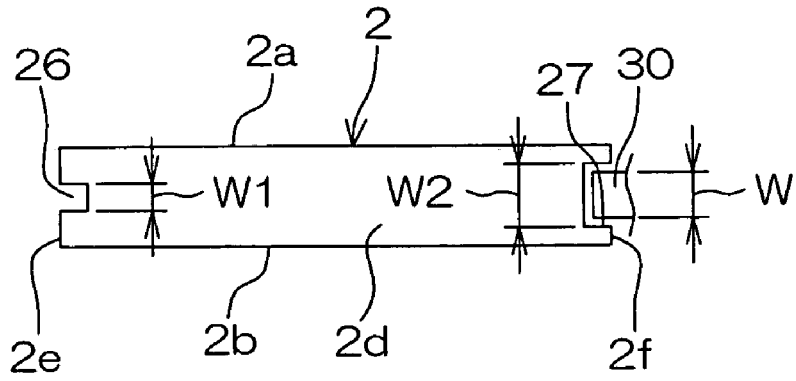
FIG. 6A is a schematic diagram illustrating a relationship between a card inserted in a normal state and an inverted card insertion preventing projection.

As shown in FIG. 6A, the width W of the inverted card insertion preventing projection 30 is greater than the width W1 of the first groove 26 and smaller than the width W2 of the second groove 27.

Referring to FIG. 6A, when the card 2 is inserted in a normal state with its front face 2*a* upward, the inverted card insertion preventing projection 30 is fitted in the corresponding wider second groove 27 of the card 2, thereby permitting the card insertion.

Figure 6B:
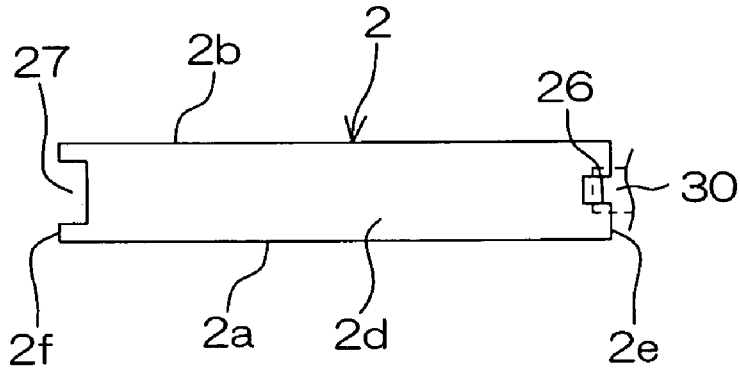
FIG. 6B is a schematic diagram illustrating a relationship between a card inserted in an inverted state and the inverted card insertion preventing projection.
Figure 7:
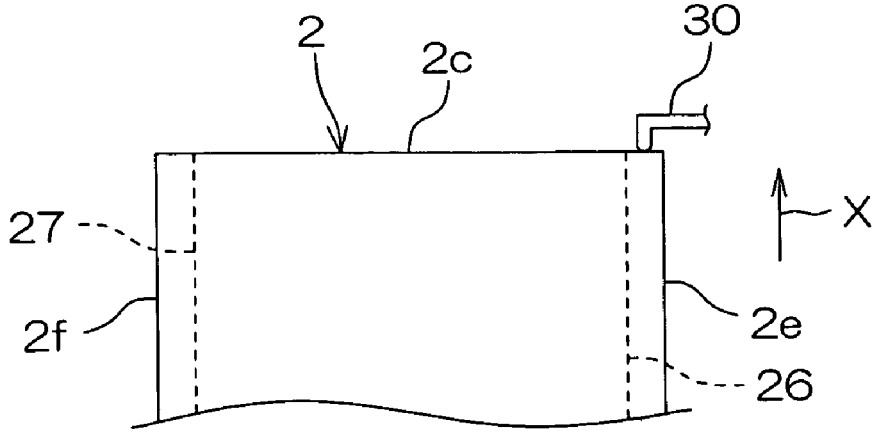
FIG. 7 is a schematic plan view illustrating the relationship between the card inserted in the inverted state and the inverted card insertion preventing projection.

On the other hand, when the card 2 is inserted in an inverted state with its rear face 2*b* upward as shown in FIG. 6B, the inverted card insertion preventing projection 30 is not fitted in the corresponding narrower first groove 26 of the card 2 to abut against the insertion side end face 2*c* of the card 2, thereby preventing the card insertion.

According to this embodiment, the lateral sides of the insertion cavity 10 are defined by the pair of side walls 5*b* and 5*c* of the second frame 5 of the channel-shaped metal plate, so that the footprint of the card connector 1 on the substrate 3 can be reduced. In addition, a user is alerted to the inverted cart insertion at a relatively early stage of the card insertion by the inverted card insertion preventing projection 30. Thus, the inverted insertion of the card 2 can assuredly be prevented.

The inverted card insertion preventing projection 30 is a projection cut and raised from the second side wall 5*c* of the second frame 5 and, therefore, the formation thereof is easy and less costly.

Figure 8:
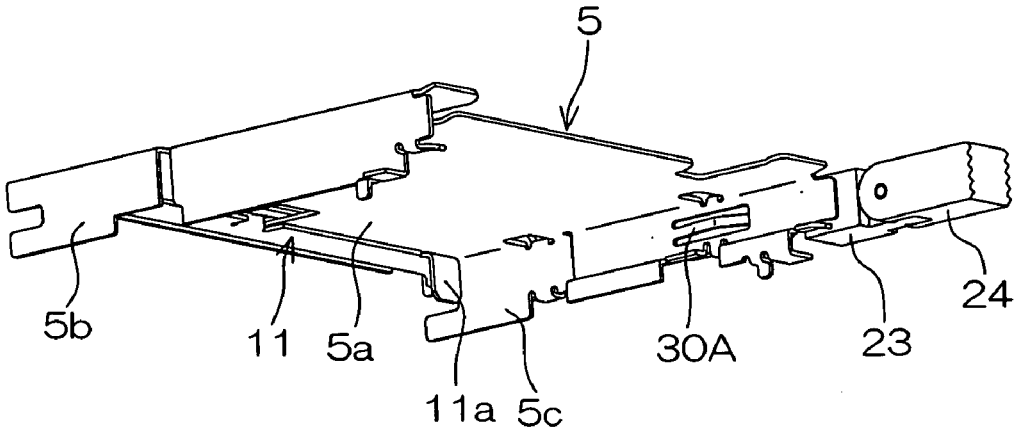
FIG. 8 is a perspective view of a second frame provided with an eject mechanism according to another embodiment of the present invention as seen from a diagonally lower side.
Figure 9:
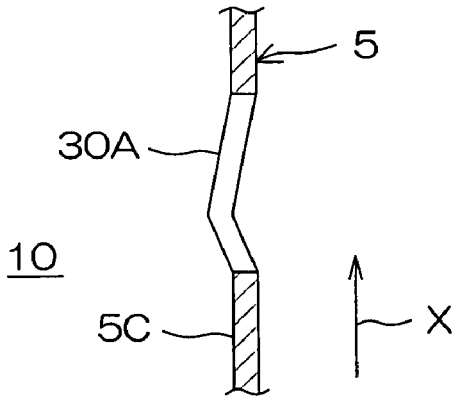
FIG. 9 is a schematic sectional view of an inverted card insertion preventing projection according to further another embodiment of the present invention.

FIG. 8 illustrates another embodiment of the present invention. Referring to FIG. 8, this embodiment differs from the embodiment of FIG. 5 in the following points. The first projection 28 provided in the embodiment of FIG. 5 is eliminated in this embodiment. The second projection 29 and the inverted card insertion preventing projection 30 are separately provided in the embodiment of FIG. 5, but an inverted card insertion preventing projection 30A supported at opposite ends thereof and doubling as the second projection is provided as shown in FIGS. 8 and 9 in this embodiment for simplification of the structure. Further, the inverted card insertion preventing projection 30A can more flexibly be laid out.

Figure 10:
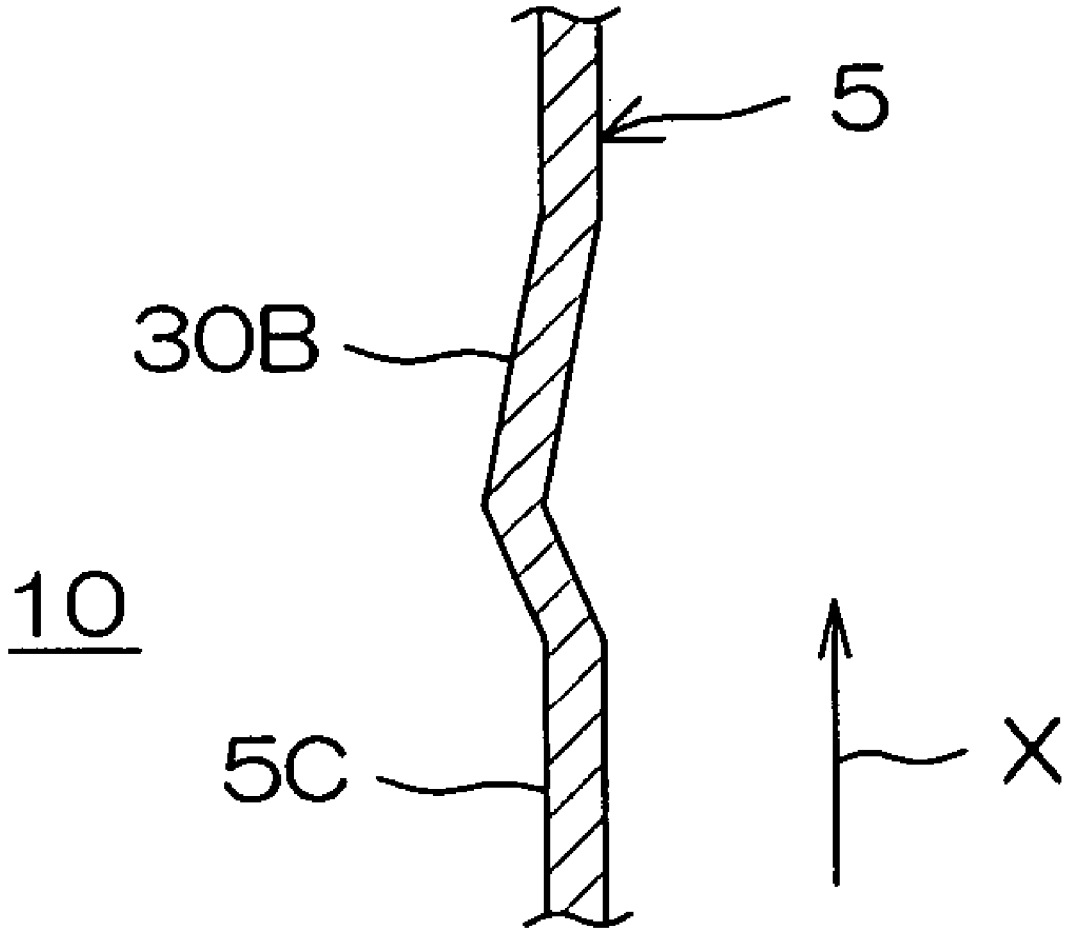
FIG. 10 is a schematic sectional view of an inverted card insertion preventing projection according to still another embodiment of the present invention.
Figure 11A:
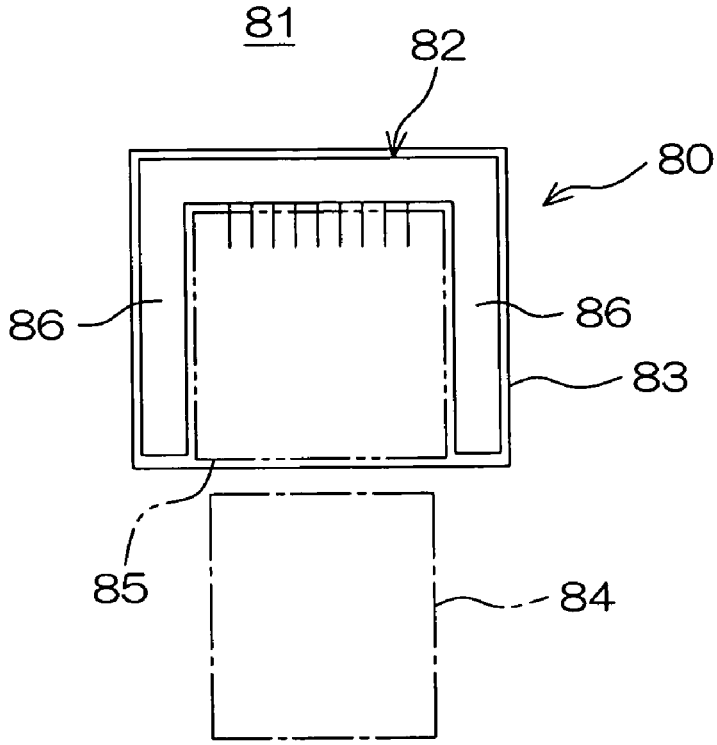
FIG. 11A PRIOR ART
FIGS. 11A and 11B are a schematic plan view and a schematic front view of a conventional card connector.
Figure 11B:
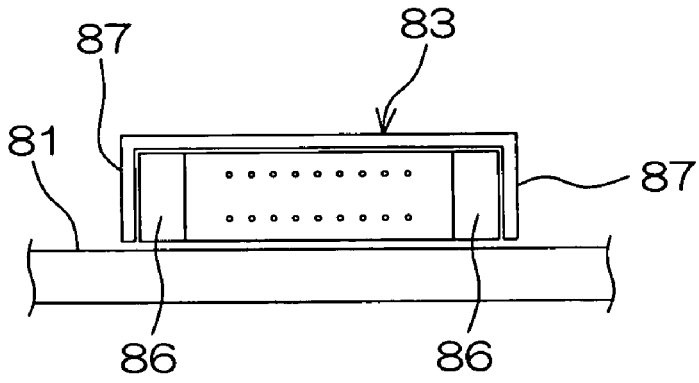
FIG. 11B PRIOR ART

The present invention is not limited to the embodiments described above. For example, an inverted card insertion preventing projection 30B bulged as shown in FIG. 10 may be provided rather than the cut and raised inverted card insertion preventing projection.

While the present invention has thus been described in detail by way of the specific embodiments thereof, those skilled in the art who understand the foregoing description will easily come up with modifications, variations and equivalents of the invention. Therefore, it should be understood that the scope of the invention be defined by the following claims and the equivalents thereof.

What is claimed is:

1. A card connector comprising:

an insertion cavity for receiving a card inserted therein in a card inserting direction;

a first insulative frame fixed to a mounting surface and defining a rear side of the insertion cavity;

a plurality of contacts held by the first frame as facing toward the insertion cavity;

a second metal frame of a channel shape fixed to the mounting surface and having a top plate parallel to the mounting surface and first and second side walls to define the insertion cavity between the mounting surface and the second frame; and an inverted card insertion preventing projection provided on one of the first and second side walls of the second frame for preventing the card from being inserted upside down into the insertion cavity;

the inverted card insertion preventing projection projecting in an area of the insertion cavity associated with a first half of a card inserting stroke.

2. A card connector as set forth in claim 1, wherein the inverted card insertion preventing projection abuts against an insertion side end face of the card to prevent the insertion of the card when the card is inserted upside down into the insertion cavity, and wherein the inverted card insertion preventing projection is fitted in a groove formed in a corresponding lateral side face of the card as extending in the card inserting direction to permit the insertion of the card when the card is inserted in a non-inverted normal state into the insertion cavity.

3. A card connector as set forth in claim 1, wherein the inverted card insertion preventing projection includes a projection cut and raised from one of the first and second side walls of the second frame.

4. A card connector as set forth in claim 3, wherein the inverted card insertion preventing projection includes a projection supported at one end thereof.

5. A card connector as set forth in claim 3, wherein the inverted card insertion preventing projection has a mountain shape as projecting in the insertion cavity and is supported at opposite ends thereof.

6. A connector as set forth in claim 1, wherein the inverted card insertion preventing projection includes a projection bulged from one of the first and second side walls of the second frame.

7. A card connector as set forth in claim 1, wherein the inverted card insertion preventing projection functions as a card grounding projection.

8. A card connector as set forth in claim 1, wherein the inverted card insertion preventing projection functions as a card guiding projection for guiding the card into the insertion cavity when the card is inserted in the non-inverted normal state into the insertion cavity.

9. A card connector as set forth in claim 1, wherein an upper side of the insertion cavity is defined by the top plate of the second frame, and lateral sides of the insertion cavity are respectively defined by the first and second side walls of the second frame.

10. A card connector as set forth in claim 1, further comprising an eject mechanism for ejecting the inserted card from the insertion cavity, wherein the eject mechanism comprises an eject arm for pressing the insertion side end face of the card inserted in the insertion cavity in a card ejecting direction, and an operation arm linked to the eject arm via a link arm, wherein the operation arm is supported slidably along an outer surface of the side wall of the second frame provided with the inverted card insertion preventing projection.

11. A card connector comprising:

an insertion cavity for receiving a card inserted in a card inserting direction through a card insertion opening into the insertion cavity;

a first insulative frame fixed to a mounting surface and defining a rear side of the insertion cavity;

a plurality of contacts held by the first frame as facing toward the insertion cavity;

a second metal frame of a channel shape fixed to the mounting surface and having a top plate parallel to the mounting surface and first and second side walls to define the insertion cavity between the mounting surface and the second frame; and an inverted card insertion preventing projection provided on one of the first and second side walls of the second frame for preventing the card from being inserted upside down into the insertion cavity;

the inverted card insertion preventing projection disposed apart from the first insulative frame in a non-contacting relationship and between the first insulative frame and the card insertion opening.

12. A card connector as set forth in claim 11, wherein inverted card insertion preventing projection includes a first portion and a second portion with the first portion projecting generally perpendicularly relative to the one of the first and the second side walls of the second frame and into the insertion cavity and relative to the card inserting direction.

13. A card connector as set forth in claim 12, wherein the second portion of the inverted card insertion preventing projection is integrally formed with the first portion to form a generally L-shaped member in plan view.

14. A card connector as set forth in claim 13, wherein the second portion is generally rectangularly shaped as viewed from the card insertion opening.

* * * * *